United States Patent [19]

Borbély et al.

[11] Patent Number: 4,751,964

[45] Date of Patent: Jun. 21, 1988

[54] HEAT EXCHANGER, MAINLY FOR USE WITH GAS HEATED DEVICES

[75] Inventors: Ferenc Borbély; Lóránt Kiss, both of Budapest, Hungary

[73] Assignee: FEG Fegyver-es Gazkeszulekgyar, Budapest, Hungary

[21] Appl. No.: 874,502

[22] Filed: Jun. 16, 1986

[30] Foreign Application Priority Data

Jul. 19, 1985 [HU] Hungary ..... 2769

[51] Int. Cl.[4] ..... F28F 13/08; F28F 21/00

[52] U.S. Cl. ..... 165/147; 165/179; 126/248

[58] Field of Search ..... 165/146, 147, 177, 179; 126/248

[56] References Cited

U.S. PATENT DOCUMENTS

| | | | |
|---|---|---|---|
| 1,261,160 | 4/1918 | Pierce | 126/248 |
| 2,181,927 | 12/1939 | Townsend | 165/147 |
| 2,246,329 | 6/1941 | Telkes | 165/146 |
| 2,276,527 | 3/1942 | Throckmorton et al. | 165/146 X |
| 2,467,668 | 4/1949 | Hallberg | 165/179 |
| 2,755,793 | 7/1956 | Keely | 126/248 |
| 3,321,002 | 5/1967 | Winkler | 165/147 X |
| 3,508,608 | 4/1970 | Roe | 165/179 |
| 3,595,299 | 7/1971 | Weishaupt et al. | 165/179 |
| 3,678,919 | 7/1972 | Marchesi | 126/248 X |
| 4,365,478 | 12/1982 | Debney | 165/179 X |
| 4,470,452 | 9/1984 | Rhodes | 165/179 X |

FOREIGN PATENT DOCUMENTS

| | | | |
|---|---|---|---|
| 177068 | 12/1953 | Austria | 165/179 |
| 310608 | 5/1929 | United Kingdom | 165/179 |
| 420347 | 11/1934 | United Kingdom | 165/179 |

*Primary Examiner*—Ira S. Lazarus
*Assistant Examiner*—Richard R. Cole
*Attorney, Agent, or Firm*—Handal & Morofsky

[57] ABSTRACT

A heat exchanger mainly for use with gas fired hot air blowers or convectors wherein the media taking part in the heat exchange are separated by a wall, a duct enclosed by the wall and constituting the flow area for the media and having a cross-sectional area diminishing in the direction of the flow and having detrusions on both sides of the wall.

4 Claims, 1 Drawing Sheet

HEAT EXCHANGER, MAINLY FOR USE WITH GAS HEATED DEVICES

TECHNICAL FIELD

The invention relates to a heat exchanger mainly used in gas heated devices, such as hot air blowers or convectors.

BACKGROUND ART

In known heat exchangers used with gas heated devices, the opposite walls of the flue duct forming the extension of the combustion chamber are parallel to each other, i.e. the cross-sectional area of said duct is practically constant. There are solutions, where, at the very most, sudden changes occur in the cross-sectional area of the flue duct.

In some known constructions one or, in some arrangements, both media are passed between helical-shape ribs arranged in an annular duct. By this method, the conditions of heat transfer are somewhat improved by the ribs, but at the same time the flow-resistance is increased considerably.

In the arrangement described in the HU-PS No. 181.107 one medium flows in tubes, the other is passed between the ribs fixed to the tubes. The thin-sheet ribs attached to the spacers between the tubes improve the heat transfer, but increase the flow-resistance.

In the heat exchangers described in the DE-PS No. 2,343.007 two ducts are provided for the media taking part in the heat-exchange. The walls confining the ducts are essentially parallel, corrugated sheets.

The known solutions exhibit thermodynamically two fundamental disadvantages. One of these may be summarized as follows: The flue gases cool down while ascending in the duct provided for them, consequently their volumetric flow and also their flow velocity decreases. Since the heat transfer coefficient is proportional with some power of the flow velocity, so the heat transfer coefficient also diminishes together with the heat flux density valid for the wall of the duct.

The other disadvantage is the following: As already mentioned the flue gases, while ascending in the flue duct, cool down and with most gas heated devices the heat absorbing medium also while ascending along the device is heated up. Thus the difference between the temperatures of the two media rapidly decrease while ascending.

Due to the reduction of the temperature difference also the transferred heat is reduced. To compensate this effect the surface participating in the process of heat exchange has to be increased; this however leads to the increase of the size and weight of the device.

By the invention the outlined deficiencies and drawbacks of the known heat exchanger constructions can be eliminated.

The aim to be accomplished by the heat exchanger according to the invention has been to prevent any reduction of the heat transfer coefficient or at least to minimize it.

DISCLOSURE OF THE INVENTION

The set aim is achieved in the heat exchanger according to the invention by reducing the cross-sectional area of the flue duct in the direction of the flow developing within the duct and by employing detrusions on both sides of the duct wall.

As a result of this dimishing cross-sectional area of the duct the flow velocity of the flue gases remains constant or reduces but slightly. But even a diminishing flow velocity does not bring about reduction of the heat transfer coefficient, because the detrusions have a counteracting effect of improving this coefficient.

A general improvement of the heat transmission coefficient is achieved by employing detrusions on both sides of the duct wall. The different conditions developing on the two sides of the duct wall may justify the application of detrusions differing in number and/or shape at the inside and at the outside surface of the duct wall. The usefulness of providing detrusions on both sides of the duct wall becomes clear when considering the following: It is known that when heat is transmitted across a wall, the coefficient of this heat transmission depends on the heat transfer coefficients valid for the two sides of said wall and on the ratio of the wall thickness to the thermal conductivity of the wall material. If the heat transfer coefficient is increased on one side of the wall this alone will not modify the heat transmission coefficient considerably, because the two other terms in the formula determining said coefficient have a much greater influence. It is therefore necessary to increase the heat transfer coefficient also on the other side of the wall. The general consideration made in the foregoing will be the following in the case of the arrangement proposed by the invention.

If the inner heat transfer coefficient of the duct wall increases by narrowing down the cross-sectional area of the duct and by providing detrusions in the duct wall toward the inside of the duct the advantages of this consition can be fully utilized by providing detrusions also in the outside surface of the duct wall in a number even higher than at the inside. The relation between the heat transfer coefficients and number of the detrusions is the following:

$$Z_K/Z_B = X_B/X_K$$

where $Z_K$ is the number of detrusions on the outer side of the wall;

$Z_B$ is the number of detrusions on the side of the wall facing the duct;

$X_B$ is the heat transfer coefficient developing on the outer side of the wall;

$X_K$ is the heat transfer coefficient valid for the internal side of the wall.

Over one section of the duct, mostly at its narrowest section, ribs may be applied instead of detrusions.

The ribs at the inside of the wall are preferably arranged with their surfaces running parallel with the direction of flow.

The detrusions may be of different shape selected by considering prevailing flow-mechanical and/or heat-technical conditions. Beside the shape of the detrusions, their relative positions may also be of importance. With oblong detrusions it may play a role whether the detrusions are parallel to the direction of flow streaming along them or are perpendicular to it. As regards the shape, position and number of detrusions a great number of combinations and variants can be found.

The essential features of the heat exchanger according to the invention is, that it comprises a duct formed by a wall, constituting the space within which one of the media flows, said duct having a cross-sectional area diminishing in the direction of flow and having detrusions on both sides of said wall.

In a further preferred embodiment of the heat exchanger according to the invention the number of detrusions on one side of the wall is higher than on the other.

In another preferred embodiment of the heat exchanger corresponding to the invention the detrusions on one side of the wall are differing in shape from those provided on the other side of the wall.

In some cases it may be of advantage to adopt an embodiment of the heat exchanger according to the invention where the detrusions are of identical shape but of different position.

In a further favourable embodiment of the proposed heat exchanger one section of the duct is provided with ribs attached to the duct wall.

Another expedient embodiment of the heat exchanger devised by the invention comprises ribs having their planes arranged substantially parallel with the direction of flow of the medium streaming in the duct.

BRIEF DESCRIPTION OF DRAWINGS

The heat exchanger according to the invention is described in detail by way of examples only with the aid of drawings, in which.

BEST MODE OF CARRYING OUT THE INVENTION

Figure 1:
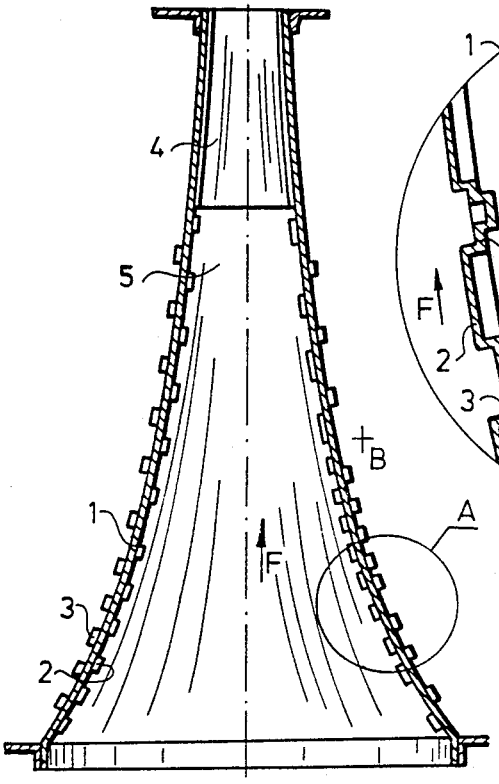
FIG. 1 is a longitudinal section of a detail of the heat exchanger according to the invention.

The heat exchanger illustrated as an example in FIG. 1 may be part of a hot air blower. A duct 5 is enclosed by walls 1. Inside the duct 5 a flue gas—medium F—flows in the direction of the arrow, whereas the wall 1 is surrounded from the outside by a medium B, which is generally the ambient air.

The shape of the longitudinal section of the duct 5 shown in FIG. 1 corresponds to the solution of the heat-transfer differetial equation with boundary condition of q=constant, where q is the heat flux density relating to the wall 1.

The differential equation mentioned above can be solved with some other boundary conditions as well. So e. g. the boundary condition of w=constant may also be considered, which means that the flow velocity w of the flue gas streaming in the duct 5 is considered as constant.

As already mentioned the aim to be accomplished by the invention has been to increase the heat flux density as much as possible by increasing the flow velocity in the duct, but beside this aim an obvious intention has been to keep the flow resistance at a value as low as possible.

In order to reduce the flow resistance the shapes of the inside detrusions 2 and the outside detrusions 3 have had to be chosen very carefully. It has been found that a detrusion bursting open the laminar boundary layer and consequently improving the heat transfer coefficient, yet imposing a minimum flow resistance is that having a drop shape or one closely approaching it.

Figure 2:
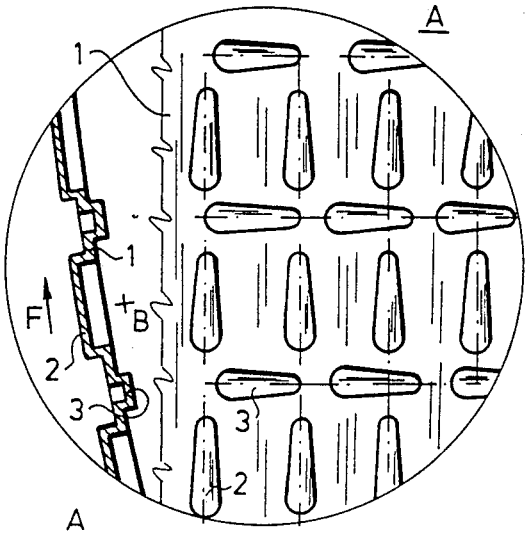
FIG. 2 illustrates, as an example, a possible arrangement of the detail A indicated in FIG. 1, shown partly as a front view and partly as a sectional drawing.

FIG. 2 illustrates such an embodiment as an example where the detrusions 2 and 3 have approximately a drop shape. Otherwise this example represents a solution where on the inner and outer sides of the wall 1 the number of the detrusions 2 and 3 are equal. That may be then necessary, if the heat transfer coefficients are closely equal along both sides of the wall 1.

Figure 3:
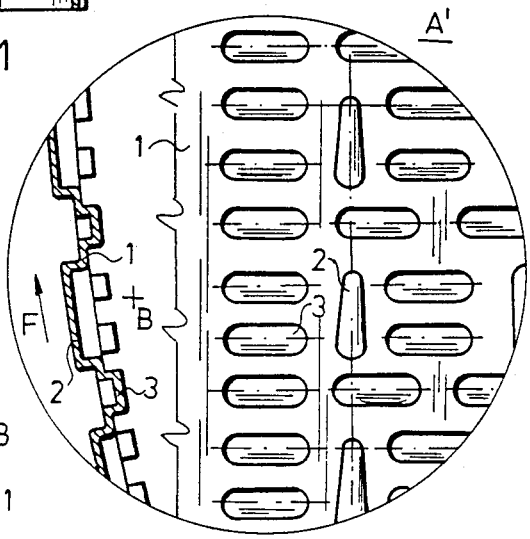
FIG. 3 is another example of the detail A of FIG. 1, also shown partly as a front view and partly as a section.

With the example illustrated in FIG. 3, the shapes of the detrusions 2 and 3 are such as to have their sides running parallel with each other. (This is only an approximation of the ideal shape.) Otherwise, this is an example, where the heat transfer coefficient along the inside of the wall 1 of the duct 5 has been specified among the design data as being three-times higher than along the outside of the wall 1, i.e. $X_B=3X_K$. Correspondingly, the number of the external detrusions 3 have had to be taken three-times higher than that of the internal detrusions 2, i.e. $Z_K=3Z_B$.

The centre lines of the detrusions 2 and 3 are parallel to the given directions of flow. Hence, e.g. with convectors the centre lines of the detrusions 2 and 3 are parallel to each other and of vertical position.

Figure 4:
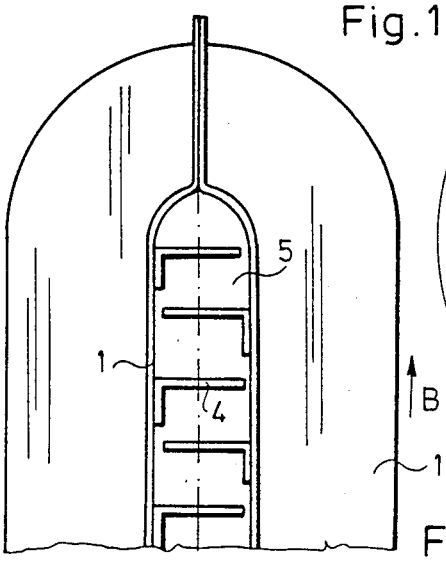
FIG. 4 is part of the top view corresponding to FIG. 1.

It can be seen from FIG. 4 that in the upper narrow section of the duct 5 the ribs 4 are attached to the wall 1. The planes of the ribs 4 are parallel with the direction of the flow of the flue gases. The ribs 4 may be arranged on the outside of the wall 1 as well.

With the heat exchanger arrangement according to the intention, considering the circumstances, optimum heat flux density, and along the wall 1 a constant or closely constant heat flux density can be achieved. As a result also the specific weight and space requirements of the proposed heat exchanger are less than those of other equipment serving similar purposes. Beside the outlined advantages also the efficiency figures are improved when using the invention in appliances where combustion takes place, e.g. in various gas-fired apparatus.

What is claimed is:

1. Heat exchanger,mainly for use with gas-fired devices, such as hot-air blowers or convectors, where the media taking part in the heat exchange are separated by a wall forming a duct constituting the flow area for the media enclosed by said wall, said duct having a cross-sectional area diminishing in the direction of flow of said media and, thereby the heat-transfer portion of said wall is a hyperbolic surface and, wherein said hyperbolic wall surface has detrusions formed on both sides thereof, wherein a greater number of detrusions are formed on one side of the wall than on its other side, said number of detrusions being inversely proportional to the ratio of the heat transfer coefficient of the two sides of the wall.

2. Heat exchanger as claimed in claim 1, characterized by having detrusions on one side of the wall differing in shape from that of the detrusions provided on the other side.

3. Heat exchanger as claimed in claim 1 characterized by having detrusions of identical shape but differing in their direction.

4. The heat exchanger as claimed in claim 3, wherein said detrusions have an elongated shape and a predetermined number of said detrusions are directed longitudinally along the direction of the flow of said media and another predetermined number of said detrusions are directed transversely to the direction of the flow of said media.

* * * * *